US009681701B2

(12) United States Patent
Dekovic et al.

(10) Patent No.: US 9,681,701 B2
(45) **Date of Patent: *Jun. 20, 2017**

(54) OUTSOLES HAVING GROOVES FORMING DISCRETE LUGS

(71) Applicant: NIKE, Inc., Beaverton, OR (US)

(72) Inventors: Denis Dekovic, Portland, OR (US); Anthony P. Daversa, Beaverton, OR (US); Sergio G. Lozano, Portland, OR (US); James C. Meschter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

This patent is subject to a terminal disclaimer.

(21) Appl. No.: 14/490,192

(22) Filed: Sep. 18, 2014

(65) Prior Publication Data

US 2015/0000164 A1 Jan. 1, 2015

Related U.S. Application Data

(62) Division of application No. 13/410,006, filed on Mar. 1, 2012, now Pat. No. 8,863,412, which is a division of application No. 12/130,354, filed on May 30, 2008, now Pat. No. 8,146,272.

(51) Int. Cl.

| | |
|---|---|
| ***A43B 13/14*** | (2006.01) |
| ***A43B 13/22*** | (2006.01) |
| ***A43B 13/16*** | (2006.01) |
| ***A43B 13/18*** | (2006.01) |
| ***A43B 13/00*** | (2006.01) |

(52) U.S. Cl.

CPC ..... *A43B 13/22* (2013.01); *A43B 13/00* (2013.01); *A43B 13/14* (2013.01); *A43B 13/141* (2013.01); *A43B 13/16* (2013.01); *A43B 13/186* (2013.01); *A43B 13/223* (2013.01)

(58) Field of Classification Search

CPC ..... A43B 13/22; A43B 13/00; A43B 13/14; A43B 13/141; A43B 13/16; A43B 13/186; A43B 13/223

USPC ..... 36/103

See application file for complete search history.

(56) References Cited

U.S. PATENT DOCUMENTS

| | | | | |
|---|---|---|---|---|
| D16,018 | S | 4/1885 | Elliott | |
| D80,361 | S * | 1/1930 | Crowley | 36/32 R |
| D90,057 | S * | 5/1933 | Van Cleef | 36/59 C |
| 1,936,729 | A | 11/1933 | Mebane | |

(Continued)

FOREIGN PATENT DOCUMENTS

| | | |
|---|---|---|
| BE | 357280 | 1/1929 |
| EP | 0965281 | 12/1999 |

(Continued)

*Primary Examiner* — Jila M Mohandesi

(74) *Attorney, Agent, or Firm* — Banner & Witcoff, Ltd.

(57) ABSTRACT

Various arrangements for an article of footwear including an outsole having grooves forming discrete lugs are presented. The outsoles generally include a plurality of grooves formed in at least a portion of the outsole that extend from a lateral side of the outsole to a medial side of the outsole. The grooves may be linear or curved and generally extend in an angular fashion. The grooves may have a first depth at a perimeter of the outsole and a second depth, greater than the first depth, at the center of the outsole. The grooves form discrete lugs. In some arrangements, the lugs are diamond shaped.

20 Claims, 7 Drawing Sheets

(56) References Cited

U.S. PATENT DOCUMENTS

| | | | | |
|---|---|---|---|---|
| 2,162,912 | A | 6/1939 | Craver | |
| D115,636 | S | 7/1939 | Sperry | |
| 2,229,406 | A | 1/1941 | Cutler | |
| D125,431 | S | 2/1941 | Starner | |
| D196,491 | S | 10/1963 | Papoutsy | |
| D197,505 | S | 2/1964 | Bingham, Jr. et al. | |
| D200,846 | S | 4/1965 | Bovay | |
| D201,864 | S | 8/1965 | Smith, III | |
| 3,662,478 | A | 5/1972 | Schwab | |
| 4,060,917 | A | 12/1977 | Canale | |
| D278,851 | S | 5/1985 | Austin | |
| D281,459 | S | 11/1985 | Parker | |
| 4,617,745 | A | 10/1986 | Batra | |
| 4,658,514 | A * | 4/1987 | Shin | A43B 5/06 36/30 R |
| D301,184 | S * | 5/1989 | Hase | D2/954 |
| D302,352 | S | 7/1989 | Austin | |
| D302,765 | S | 8/1989 | Esser | |
| 4,910,887 | A | 3/1990 | Turner | |
| D307,816 | S | 5/1990 | Schneider | |
| D307,817 | S | 5/1990 | Schneider | |
| D316,627 | S | 5/1991 | Schneider | |
| 5,012,597 | A | 5/1991 | Thomasson | |
| 5,676,295 | A | 10/1997 | Gelb | |
| D388,594 | S | 1/1998 | Turner et al. | |
| D394,342 | S | 5/1998 | Schneider | |
| D414,317 | S | 9/1999 | Lubart | |
| 6,076,283 | A | 6/2000 | Boie | |
| 6,115,945 | A | 9/2000 | Ellis | |
| D433,792 | S | 11/2000 | Cockrell | |
| 6,161,315 | A | 12/2000 | Dalton | |
| 6,202,325 | B1 | 3/2001 | Kim | |
| D446,915 | S | 8/2001 | Cockrell | |
| D446,916 | S | 8/2001 | Cockrell | |
| D447,326 | S * | 9/2001 | Cockrell | D2/959 |
| D463,901 | S | 10/2002 | Adams et al. | |
| 6,519,875 | B1 | 2/2003 | Beard | |
| 6,574,889 | B2 | 6/2003 | Cagner | |
| D479,035 | S * | 9/2003 | Adams | D2/957 |
| D483,934 | S | 12/2003 | Adams et al. | |
| 6,793,996 | B1 * | 9/2004 | Umezawa | A43B 5/001 36/126 |
| D507,172 | S | 7/2005 | VanTichelt | |
| D509,650 | S | 9/2005 | Burg | |
| D509,949 | S | 9/2005 | Wu | |
| D509,950 | S | 9/2005 | Adams et al. | |
| D511,881 | S | 11/2005 | Cockrell | |
| 6,990,755 | B2 | 1/2006 | Hatfield | |
| D514,287 | S | 2/2006 | Cockrell | |
| D527,172 | S * | 8/2006 | Burg | D2/953 |
| D529,694 | S | 10/2006 | Cockrell | |
| D529,695 | S | 10/2006 | Cockrell | |
| D529,696 | S | 10/2006 | Cockrell | |
| D530,067 | S | 10/2006 | Cockrell | |
| D530,894 | S | 10/2006 | Cockrell | |
| D530,895 | S | 10/2006 | Cockrell | |
| D531,788 | S | 11/2006 | Rittberg | |
| D543,340 | S | 5/2007 | Favreau et al. | |
| D545,036 | S | 6/2007 | Roulo | |
| D553,835 | S | 10/2007 | McClaskie | |
| 7,287,342 | B2 | 10/2007 | Keen | |
| D562,541 | S | 2/2008 | Avar | |
| 8,146,272 | B2 | 4/2012 | Dukovic | |
| 2004/0064973 | A1 | 4/2004 | Talbott | |
| 2007/0169376 | A1 | 7/2007 | Hatfield et al. | |

FOREIGN PATENT DOCUMENTS

| | | |
|---|---|---|
| EP | 1832191 | 9/2007 |
| GB | 1518866 | 7/1978 |
| GB | 2431857 | 5/2007 |
| JP | 2007508055 A | 4/2007 |
| WO | 2007103476 A2 | 9/2007 |

* cited by examiner

OUTSOLES HAVING GROOVES FORMING DISCRETE LUGS

RELATED APPLICATION DATA

This application is a divisional of U.S. patent application Ser. No. 13/410,006 filed Mar. 1, 2012, which application is a divisional of U.S. patent application Ser. No. 12/130,354, filed May 30, 2008, now U.S. Pat. No. 8,146,272, issued Apr. 3, 2012, in the names of Denis Dukovic, Anthony Deversa, Sergio Lozano, and Jay Meschter and entitled "Outsole Having Grooves Forming Discrete Lugs." These earlier priority applications are each entirely incorporated herein by reference.

FIELD OF THE INVENTION

This invention relates generally to articles of footwear. In particular, the invention relates to outsoles for articles of footwear having a plurality of grooves traversing the outsole to form discrete lugs in the outsole.

BACKGROUND

Articles of footwear and, in particular, athletic shoes, generally include an outsole configured for contacting the ground. The outsole provides impact attenuation for the wearer and, in some arrangements, provides traction for the wearer. The configuration of the outsole can reduce flexibility of the article of footwear or cause the article of footwear to reduce the natural flexibility of the foot as a user walks, runs, etc. In addition, the outsole generally adds additional weight to the article of footwear which, in some sports, can be detrimental to the performance of the wearer. Finally, the outsole generally receives a considerable amount of wear by contacting the ground with each step.

SUMMARY

The following presents a general summary of aspects of the invention in order to provide a basic understanding of the invention and various features of it. This Summary is not intended to limit the scope of the invention in any way, but it simply provides a general overview and context for the more detailed description that follows.

Aspects of this invention relate to articles of footwear having outsoles with grooves formed in at least a portion of the outsole. The grooves may have a constant depth or a depth that varies as the groove extends laterally across the outsole from a medial side to a lateral side or vice versa. The grooves form discrete lugs that, in some arrangements, are diamond shaped. In addition, the maximum depth of each groove may vary based on the location of the groove on the outsole. For instance, grooves in a midfoot region may be deeper than grooves in a toe region of the outsole.

The outsoles may include secondary regions formed of a material different from the remainder of the outsole. These secondary regions may be formed within one or more of the diamond shaped lugs and may provide additional support for the wearer. In addition, the discrete lugs may include a surface enhancement feature, such as a pattern or texture. In some arrangements, the surface enhancement feature is an aperture extending at least partially through the outsole.

BRIEF DESCRIPTION OF THE DRAWINGS

A more complete understanding of the present invention and certain advantages thereof may be acquired by referring to the following detailed description in consideration with the accompanying drawings, in which.

Figure 1:
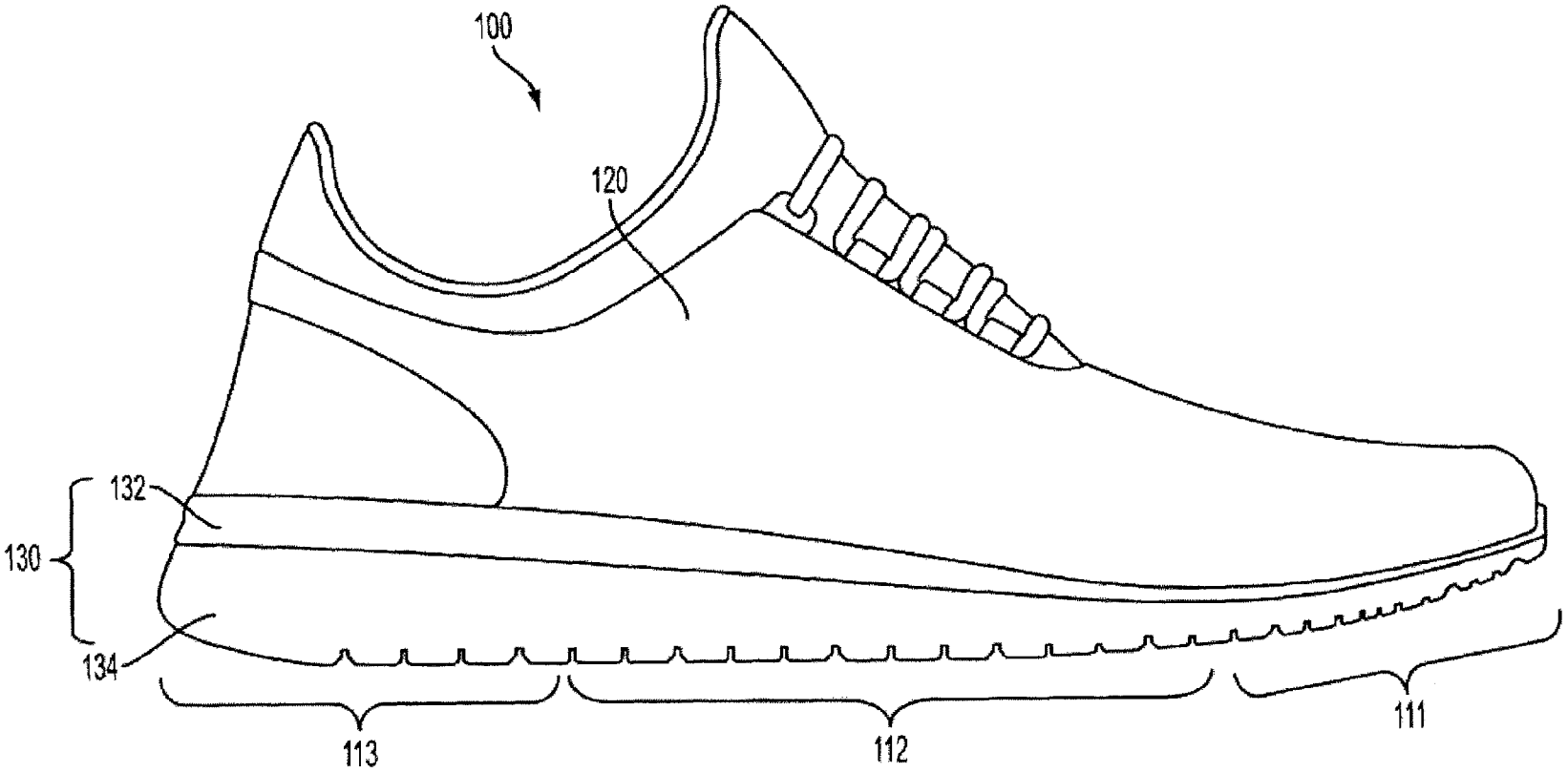
FIG. 1 is a side view of an article of footwear that includes an outsole arrangement according to aspects of the invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example articles, including one or more outsole structures. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to articles of footwear having grooves formed in the outsole to form discrete, diamond shaped lugs. However, aspects of the invention may include grooves forming lugs of other shapes such as triangular, square, rectangular, and the like, and nothing in the specification or figures should be construed to limit the invention to grooves forming diamond shaped lugs. In addition, the outsoles described herein may be used with any suitable conventional midsole, such as a foam midsole, column type midsole, air filled bladder midsole, and the like.

A. General Description of an Outsole for an Article of Footwear or Other Elements According to the Invention In general, as described above, aspects of this invention relate to outsoles for articles of footwear having grooves formed in the outsole that define discrete lugs or other elements. More detailed descriptions of aspects of this invention follow.

1. Example Outsoles for Articles of Footwear or Other Elements, According to the Invention Aspects of this invention relate to outsoles for articles of footwear having grooves formed in at least a portion of the outsole. In at least some examples, the grooves, which provide flexibility for the article of footwear, form discrete lugs that aid in providing traction for the article of footwear. In some examples, the discrete lugs are diamond shaped. In at least some examples, the grooves extend angularly across the outsole from a lateral side of the outsole to a medial side of the outsole. In addition, the depth of each groove may vary as the groove extends from at or near the perimeter of the outsole to a central region of the outsole. For example, the groove may have a first depth at the perimeter of the outsole and gradually become deeper as the groove nears the center of the outsole. As the groove continues to extend from the center of the outsole to the opposite side, the groove may gradually become shallower. In at least some arrangements in accordance with this invention, the groove depth profile will be symmetric. However, asymmetric arrangements may also be used.

The outsoles may also include a second plurality of grooves formed in at least a portion of the outsole. The second plurality of grooves may also extend angularly from the lateral side of the outsole to the medial side of the outsole. In at least some examples, the grooves of the second plurality of grooves have a constant groove depth profile. That is, the depth of each groove does not vary as the groove extends from the perimeter of the outsole to the center of the outsole.

The outsoles according to at least some examples of this invention may include stiffening regions. These stiffening regions may be formed in the toe region, midfoot region, or heel region. Generally, the stiffening regions are formed of a material different from the material forming the remainder of the outsole. In at least some examples, the stiffening region material is stiffer or harder than the material of the remainder of the outsole.

In still other examples of the invention, the individual discrete lugs of an outsole structure may include a surface enhancement feature. This surface enhancement feature may be a texture or pattern formed on the lug. Additionally or alternatively, the surface enhancement feature may be a raised region formed in the lug or a recessed region formed in the lug. In at least some examples, the surface enhancement feature may be an aperture that extends partially or entirely through the outsole. The aperture may aid in providing additional traction and may reduce the weight associated with the outsole.

Some outsoles according to aspects of the invention may include a forward outsole region and a rear outsole region. The forward outsole region may be formed of conventional outsole materials and may include the groove and discrete lug arrangement described herein. In addition, the outsole may include a heel support system in the rear outsole region. This heel support region may be formed of a material different from the forward outsole region and may include a heel support impact attenuating system. This heel support impact attenuating system may be configured to provide additional impact attenuation for the wearer and may include at least one of an air filled bladder, a foam impact attenuating insert, or one or more column type impact attenuating members.

Additional aspects and specific examples of the articles described above will be described in detail more fully below. The reader should understand that these specific examples are set forth merely to illustrate examples of the invention, and they should not be construed as limiting the invention.

B. Specific Examples of the Invention

Referring to the figures and following discussion, articles of footwear in accordance with the present invention are described. Footwear is depicted and discussed as running shoes, however, the concepts disclosed with respect to footwear may be applied to a wide range of other athletic footwear styles, including walking shoes, tennis shoes, soccer shoes, basketball shoes, football shoes, and cross-training shoes, for example. In addition, the concepts of the present invention may be applied to a wide range of non-athletic footwear, including work boots, sandals, loafers, and dress shoes. Accordingly, the present invention is not limited to the precise embodiments disclosed herein, but applies to footwear generally.

FIG. 1 illustrates one article of footwear that may generally be used with aspects of the invention described herein. Footwear 100 includes an upper 120 that is connected to a sole structure 130. Upper 120 may be a conventional or non-conventional upper that includes, for example, layers of foam materials, synthetic textiles, and leather that are stitched or adhesively bonded to each other to form a comfortable structure for receiving a foot. Sole structure 130 may include an insole or sock liner which is a thin cushioning member generally located within upper 120 and at a position that corresponds with the sole of the foot, thereby enhancing the comfort of footwear 100. Sole structure 130 also may include a midsole 132 that forms the primary impact attenuating layer of footwear 100 and serves, therefore, to attenuate ground reaction forces and absorb energy when footwear 100 is compressed against the ground. In addition, sole structure 130 includes an outsole 134. Outsole 134 forms the primary ground-contacting surface of footwear 100 and may be fashioned from a wear-resistant material, such as carbon black rubber compound, and may include texturing to enhance traction. Various example outsole configurations will be described more fully below.

During running or other activities that compress sole structure 130 between the foot and the ground, footwear 100 provides impact force attenuation. That is, footwear 100 attenuates ground reaction forces and absorbs energy that would otherwise be transferred to the leg and foot of the individual. The degree of impact attenuation provided by footwear 100 is generally related to the overall stiffness of sole structure 130. In general, a greater stiffness corresponds with lesser impact attenuation, whereas lesser stiffness corresponds with greater impact attenuation. Accordingly, stiffness and cushioning are generally correlated through an inverse relationship.

The various elements of sole structure 130 will now be discussed in detail. To aid in the following discussion, footwear 100 may be divided into three general regions: a forefoot or toe region 111 that generally corresponds with a front portion of the foot, including the toes; a midfoot region 112 that generally corresponds with a middle portion of the foot that includes the arch; and a heel region 113 that generally corresponds with the heel. Regions 111-113 are not intended to demarcate precise areas of footwear 100. Instead, regions 111-113 are intended to define general areas that aid in the following discussion.

Midsole layer 132 may be attached directly to upper 120 throughout the length of footwear 100 and supplies a portion of the impact attenuation characteristics provided by sole structure 130. In toe region 111, midsole layer 132 generally extends between upper 120 and outsole 134. An upper surface of the midsole layer 132 may be contoured to conform to the shape of the foot. Accordingly, midsole layer 132 may include a raised arch on the medial side of midfoot region 112, raised peripheral areas extending around sides of the foot, and a depression for receiving the heel, for example. The thickness of midsole layer 132 may vary along the length of footwear 100. For example, midsole layer 132 may have a relatively constant thickness in heel region 113 and midfoot region 112. In toe region 111, however, the thickness of midsole layer 132 may decrease to a point at the front of footwear 100. Suitable materials for midsole layer 132 include foam materials, such as ethylvinylacetate and polyurethane foam, which are commonly incorporated into the midsoles of conventional footwear. If desired, the midsole 132 may include a fluid-filled bladder, e.g., embedded within the foam of the midsole material.

Figure 2:
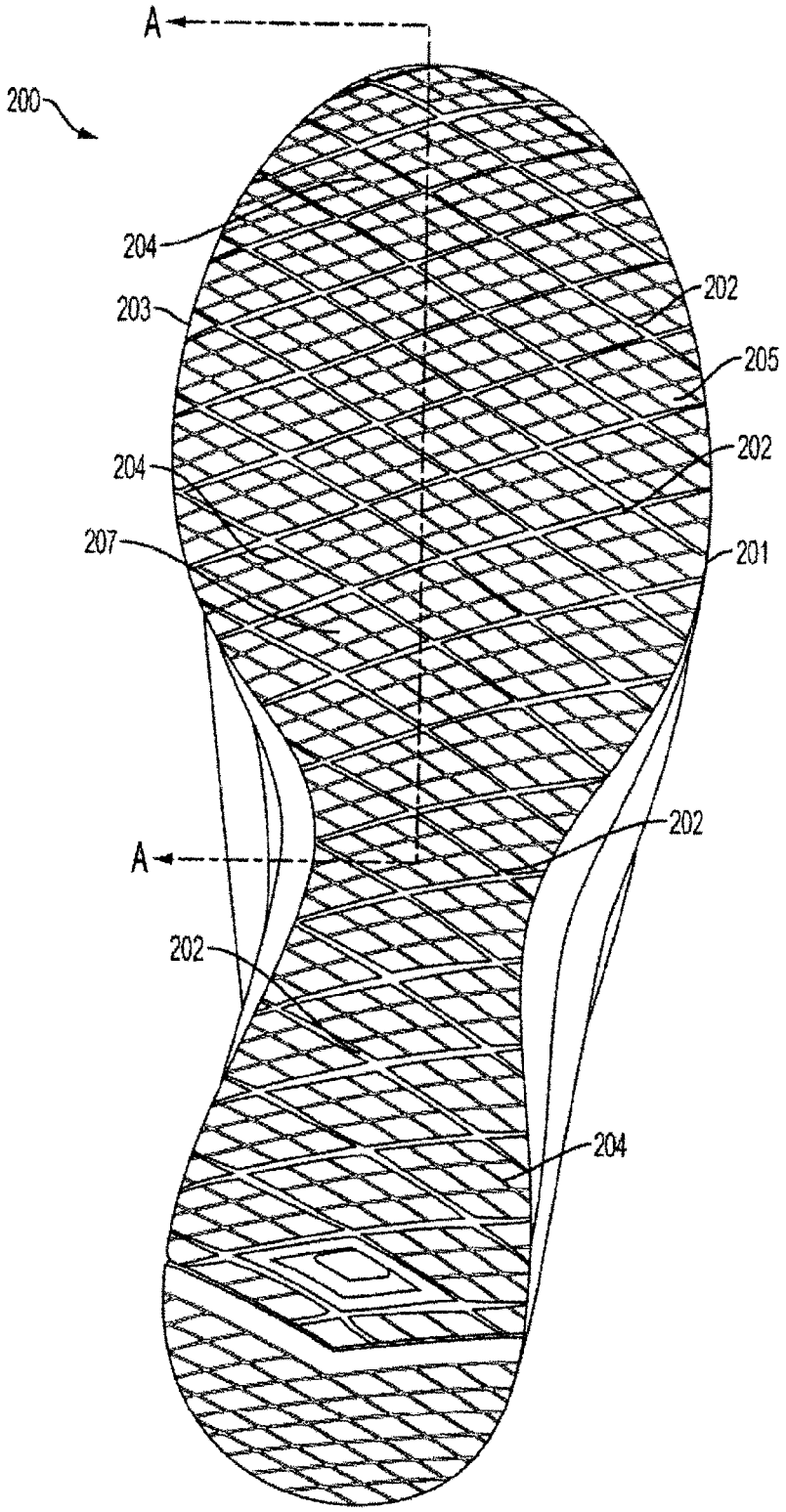
FIG. 2 is a bottom view of an article of footwear showing one outsole arrangement according to aspects of the invention.

FIG. 2 illustrates an example outsole 200 having a plurality of grooves 202, 204 as described above. The grooves 202, 204 generally traverse the outsole 200 from a lateral side 201 to a medial side 203. In addition, the grooves 202, 204 are generally arranged in the toe region 111, midfoot region 112 and heel region 113. Additional arrangements will be described below wherein the grooves 202, 204 are formed in varying combinations of the regions of the foot.

The grooves 202, 204 of FIG. 2 are arranged angularly on the outsole 200. That is, the grooves 202, 204 extend from a point close to the toe region 111 to a point closer to the heel region 113, or vice versa. This arrangement provides grooves 202, 204 extending diagonally across the outsole 200. These diagonally extending grooves 202, 204 intersect to form discrete lugs 205, 207. The lugs 205, 207 shown in FIG. 2 are diamond shaped and may provide additional traction for a user.

The grooves 202, 204 of FIG. 2 include grooves of varying depths. For instance, the arrangement of FIG. 2 includes shallow grooves 204 extending across the entire outsole 200. The term "shallow grooves" is not intended to imply any specific depth. Rather, the term shallow indicates a depth relative to other grooves formed in the outsole (i.e., deep grooves that will be discussed more fully below). These shallow grooves 204 aid in flexibility of the shoe. In addition, these shallow grooves 204 form individual, discrete, diamond shaped lugs 205 that aid in providing traction for the wearer. In some examples, the shallow grooves 204 may range from 1.0 mm to 5.0 mm deep. However, the shallow grooves 204 may be any reasonable depth and are not limited to the range recited.

The outsole 200 of FIG. 2 also includes a plurality of deep grooves 202. The term "deep grooves" is not intended to imply any particular depth but rather to indicate a depth relative to other grooves formed in the outsole (i.e., shallow grooves described above). These deep grooves 202 are formed in the outsole 200 to a greater depth than the shallow grooves 204 extending across the entire outsole 200. In addition, as shown, fewer deep grooves 202 are formed in the outsole 200 than shallow grooves 204. These deep grooves 202 provide additional flexibility and may be configured in certain areas of the shoe in which additional flexibility would be advantageous, i.e., the toe region 111 below the ball of the foot, the midfoot region 112 below the arch of the foot, etc. In some arrangements, the deep grooves 202 may range from 0.1 cm to 3.0 cm deep. However, the deep grooves 202 may be any reasonable depth and are not limited to the range recited.

These deep grooves 202 also form discrete, diamond shaped lugs 207, similar to the diamond shaped lugs 205 formed by the shallow grooves 204. In the arrangement of FIG. 2, the deep grooves 202 are formed such that the lugs 207 formed include a plurality of diamond shaped lugs 205 formed by the shallow grooves 204. This arrangement of individual lugs 205, and lugs 207 grouped together, provides flexibility for the shoe as well as traction for the wearer. In addition, the deep grooves 202 may aid in lengthening the useful life of the shoe by providing lugs 205, 207 that can sustain substantial wear, i.e., reduction in the thickness of the outsole, but continue to provide traction and flexibility for the wearer.

Figure 3A:
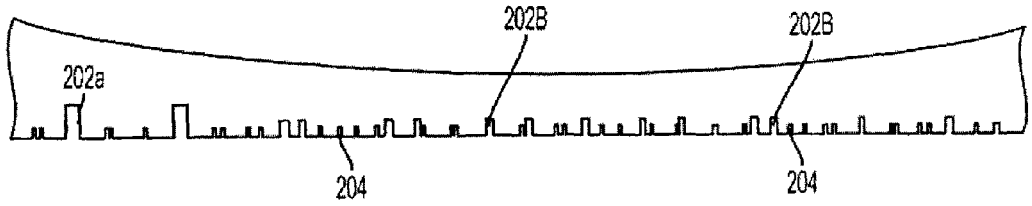
FIG. 3A is a cross-sectional view of the outsole of FIG. 2 and taken along lines A-A of FIG. 2.

In addition, the deep grooves 202 formed in the outsole 200 may have varying depths. For instance, the deep grooves 202 may have a greater maximum depth in the midfoot region 112 than in the toe region 111 or heel region 113 to allow for additional flexibility in that region. As shown in the cross section in FIG. 3A, taken along line A-A in FIG. 2, the grooves 202*a* formed in the arch region of the foot may be deeper than those formed in the toe 111 or heel region 113 (i.e., deep grooves 202*b*). In addition, the deep grooves (not shown in FIG. 3A) in the heel region 113 may have a lesser maximum depth than the deep grooves 202*b* in the toe region 111 because generally less flex is desired in the heel region 113 as compared with the toe region 111 under normal wear conditions. The arrangement and varying depth of the grooves in different regions of the outsole 200 may aid in providing a natural motion to the wearer of the shoe. For instance, the variety of groove depths and number of grooves in each region may aid in allowing the shoe to flex in multiple directions, similar to the natural ability of the foot to flex. The grooves work in conjunction with each other to provide uniform flexing in multiple directions to increase comfort for the wearer.

In addition, the depths of each deep groove 202 may vary as the groove 202 extends from the lateral side 201 of the shoe toward the medial side 203 of the shoe. For instance, a groove 202 may gradually increase in depth as it extends from the edge of the outsole, i.e., the medial 203 or lateral 201 side of the outsole 200, toward a center of the outsole 207. In this arrangement, the groove 202 may gradually decrease in depth as it extends from the center 207 of the outsole 200 to the side opposite the starting point of the groove 202.

The cross sections of various deep grooves formed can be the same or similar depending on the region of the shoe. For instance, the cross section for deep grooves formed in the toe region 111 may be the same as or similar to deep grooves formed in the midfoot region 112 and heel region 113. Alternatively, the deep grooves of the midfoot 112 and heel 113 region may have a different cross section from those of the toe region 111. In addition, although the maximum depth shown and described is generally in the center of the outsole 200, the maximum depth may be positioned closer to the lateral 201 or medial 203 side of the shoe as desired.

Figure 3B:
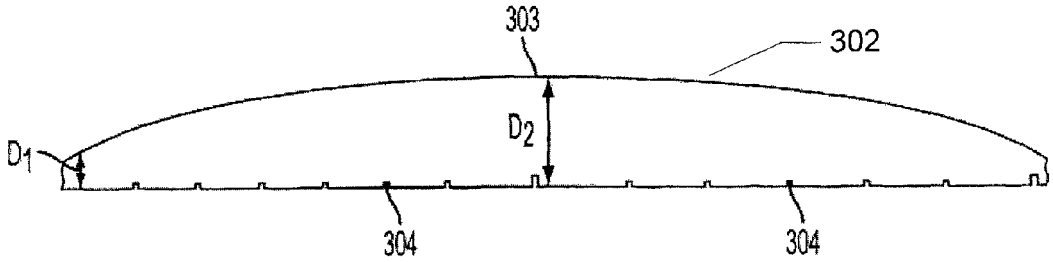
FIG. 3B is an alternate cross-sectional view of the outsole of FIG. 2 and taken along line B-B of FIG. 4.
Figure 4:
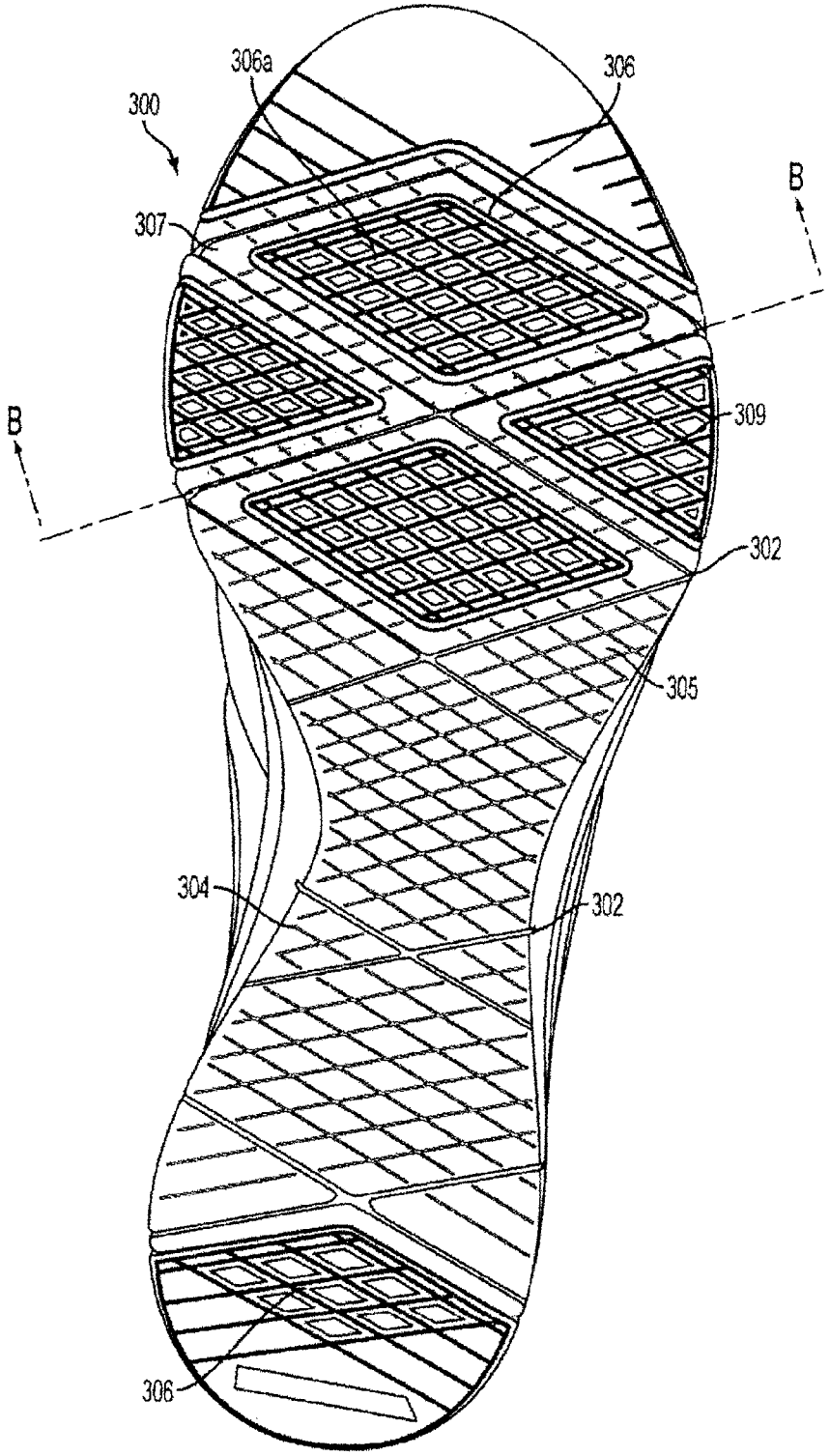
FIG. 4 is a bottom view of an article of footwear having an alternate outsole arrangement according to aspects of the invention.

FIG. 3B provides a cross section along line B-B shown in FIG. 4. Although the cross section of the deep groove 302 shown is in the toe region (111 in FIG. 1), a similar cross section may be formed by the deep grooves in the midfoot (112 in FIG. 1) and heel region (113 in FIG. 1), although the maximum depth of the groove in each region may vary. The groove 302 shown in FIG. 3B illustrates the change in depth of the deep groove 302 as it extends from the outer edges of the outsole 300 toward the center of the outsole 300. As shown, the depth of the deep groove 302 near the edge of the outsole may be relatively shallow. In some examples, the depth of the deep groove 302 at or near the edge of the outsole 300 may be between 0.05 cm and 1.0 cm. In one arrangement, the groove 302 may extend to the edge of the outsole and may end at a point where the groove 302 is no longer recessed from the bottom surface of the outsole. That is, the deep groove 302 may become flush with the bottom surface of the outsole in some examples. With further reference to FIG. 3B, as the deep groove 302 extends from a point near the outer edge of the outsole 300 toward the center 303 of the outsole 300, the deep groove 302 becomes gradually deeper. That is, the depth gradually increases from the initial depth $D_1$ to a second depth $D_2$. In some examples, such as the one shown in FIG. 3B, the deepest point of the deep groove 302 may be at or near the center 303 of the outsole 300. In some arrangements, the deep groove 302 may extend to a maximum depth between 0.2 cm and 3.0 cm. However, the deep groove 302 may be any reasonable depth and is not limited to the range recited.

As shown in FIG. 3B, the groove 302 may have a groove depth profile that is substantially symmetric, i.e., the depth of the groove 302 at the lateral side and medial side are substantially equal and the grade at which the groove 302 deepens is generally the same from the medial side to the center as from the lateral side to the center. Alternatively, the groove 302 may have a groove depth profile that is asymmetric, i.e., the groove 302 may have an alternate degree of grade of depth as it extends from either the lateral side to the center or from the medial side to the center. This asymmetrical arrangement may allow for additional flexibility on either the lateral side or the medial side as desired. Alternatively, the groove depth profile may include a step-down arrangement rather than a gradual increase in depth. For example, the groove may have a first depth near the perimeter of the outsole and may extend inward toward the center a predetermined distance before a step change in depth. The groove may then extend a predetermined distance at this second depth until another step change in depth. The groove may extend in this manner until a maximum depth is reached.

With further reference to FIG. 4, additional potential features of an example outsole 300 having grooves 302, 304 forming discrete lugs 305, 307 that may be diamond shaped lugs are illustrated. The arrangement shown includes a plurality of shallow grooves 304 formed throughout the outsole 300. As shown, the shallow grooves 304 are formed over a substantial portion of the outsole 300. In some examples, the shallow grooves 304 may be formed over the entire outsole 300 or over a smaller portion of the outsole 300 than shown in FIG. 4. In addition, deep grooves 302 are formed throughout the outsole 300. For instance, a plurality of deep grooves 302 are formed in the toe region (111 in FIG. 1). In addition, one or more deep grooves 302 may be formed in the midfoot region (112 in FIG. 1) below the arch of the foot. Further, one or more deep grooves 302 may be formed in the heel region (113 in FIG. 1). The arrangement of FIG. 4 includes fewer deep grooves 302 than the arrangement of FIG. 2. However, more or fewer deep grooves 302 may be formed in the outsole 300 of FIG. 4.

Similar to the arrangement of FIG. 2, the shallow grooves 304 of FIG. 4 form discrete, diamond shaped lugs 305 in the outsole 300. The deep grooves 302 form larger diamond shaped lugs 307 comprised of the individual diamond shaped lugs 305 formed by the shallow grooves 304. This arrangement provides flexibility and traction for the wearer. The deep grooves 302 of FIG. 4 may be formed similar to the deep grooves 202 of FIG. 2. That is, the deep grooves 302 may be deeper in or near the center of the outsole than at or near the outer edge of the outsole. In addition, the grooves may be symmetric or asymmetric, as discussed above.

The outsoles of FIGS. 2 and 4-7 may be formed of any suitable material, including materials that are conventionally known or used in the art, such as rubber, plastic, etc. With further reference to FIG. 4, one or more regions 306 of the outsole 300 may be formed of a material different from the remainder of the outsole. For example, the outsole 300 shown in FIG. 4 includes a plurality of stiffening or hardened regions 306. These regions 306 are formed within one or more of the diamond shaped lugs 307 formed by the deep grooves 302 and are formed of a material generally stiffer or harder than the material from which the remainder of the outsole 300 is formed. In one arrangement, the stiffening regions 306 may be formed of a plastic material that is substantially harder and/or stiffer than the material of the remainder of the outsole. These stiffening regions 306 may provide additional support to the wearer. In addition, the stiffening regions 306 may provide additional resistance to wear. The stiffened or hardened regions 306 may be made from materials similar to that used for the other outsole regions, as described above, but simply harder or stiffer versions of these materials.

The stiffening regions 306 of FIG. 4 are generally formed of a plurality of diamond shaped stiffening lugs **306*a*. These regions 306 may be formed as a single piece and connected to the outsole using known methods such as adhesives and the like. Alternatively or additionally, the stiffening lugs 306*a* may be formed individually and connected to the outsole 300. The stiffening lug 306*a* arrangement aids in providing continued flexibility in the stiffening regions 306, while adding additional support and wear resistance with the stiffer materials. In the arrangement of FIG. 4, the stiffening regions 306 are generally formed in the toe region (111 in FIG. 1) and/or in the heel region (113 in FIG. 1**). These regions of the shoe generally benefit from additional support and wear resistance.

In addition to the diamond shaped stiffening regions 306, additional stiffening regions 309 may be formed throughout the outsole. For instance, FIG. 4 includes a lateral and medial stiffening region 309 in the toe region of the outsole 300. These regions 309 provide additional support and wear resistance along the edge of the outsole 300 to accommodate different gaits of the user. For instance, individuals who may over-pronate or under-pronate may strike the ground on the lateral or medial side of the foot, rather than in a central region. Accordingly, those users may benefit from additional support and wear resistance on the outer edges of the outsole in the toe region.

Figure 5:
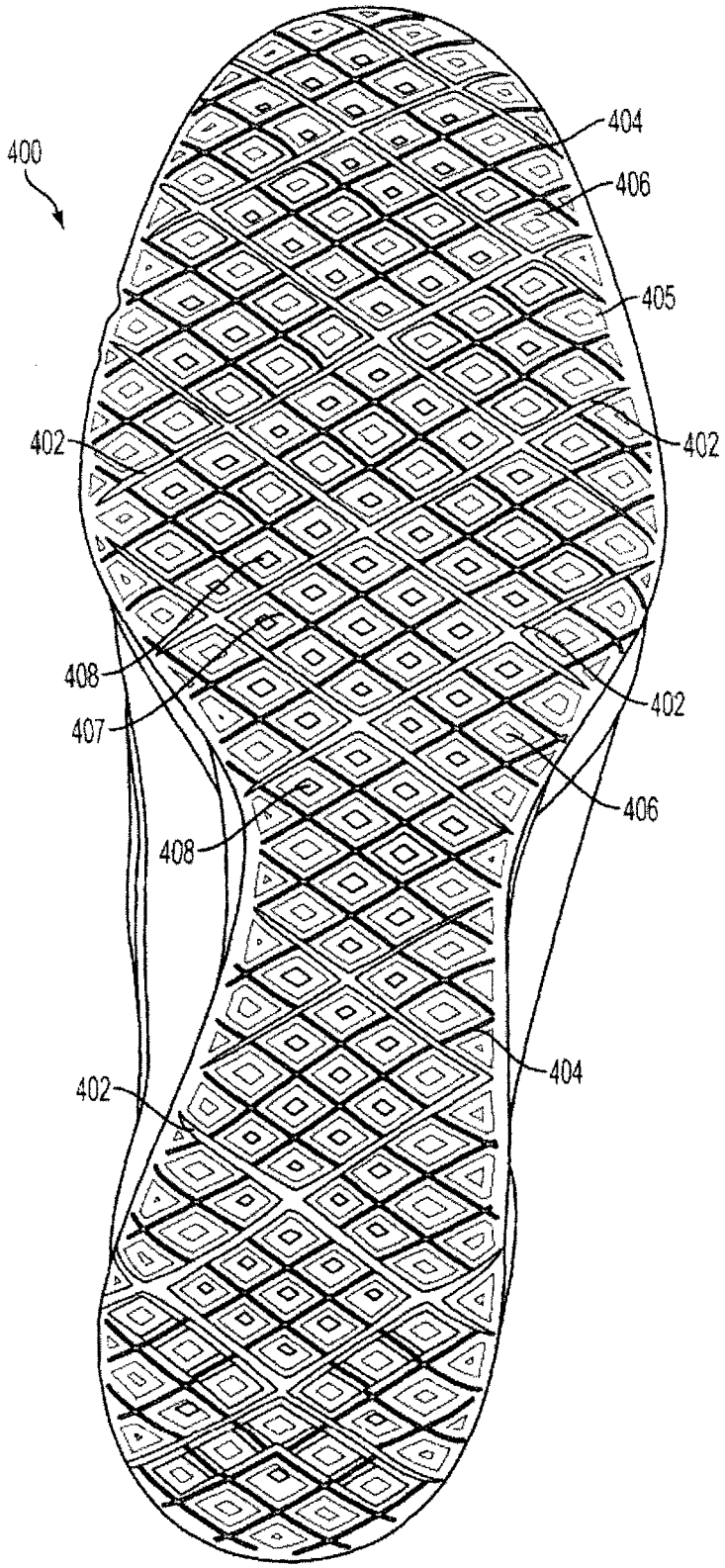
FIG. 5 is a bottom view of an article of footwear having yet another outsole arrangement according to aspects of the invention.

FIG. 5 illustrates yet another example outsole 400 having grooves 402, 404 forming a diamond shaped lug arrangement. As shown, the outsole 400 of FIG. 5 includes a plurality of shallow grooves 404 formed over substantially all of the outsole 400 forming individual diamond shaped lugs 405. In addition, a plurality of deep grooves 402 is formed throughout the outsole 400, similar to the deep grooves formed in the outsoles discussed above. As with each of the outsole arrangements described herein, both the shallow and deep grooves may be formed over the entire outsole or one or more portions or regions of the outsole. The deep grooves 402 of FIG. 5 are generally evenly spaced along the entire outsole 400. However, various spacing arrangements may be used and more or fewer deep grooves 402 may be formed in the outsole 400 without departing from this invention. Similar to the arrangements described above, the deep grooves 402 may have varying depths and groove depth profiles, and these deep grooves 402 may generally form discrete diamond shaped lugs 407 that encompass a plurality of the individual diamond shaped lugs 405 formed by the shallow grooves 404.

The individual diamond shaped lugs 405 of FIG. 5 may include a surface enhancement feature 406, such as a textured or raised portion. Additionally or alternatively, some lugs 405 may include a recess formed in the lug 405. These features may provide additional traction for the user, as well as additional impact attenuation. The surface enhancement feature may be integrally formed with the outsole 400 or may be formed as a separate component and connected to the outsole 400 using known methods of attachment. In some arrangements, one or more of the surface enhancement features may be formed of a material different from the material from which the remainder of the outsole 400 is formed. For instance, one or more textured or raised portions may be formed from a material that is stiffer or harder than the remainder of the outsole 400 to provide additional support and wear resistance for the user.

With further reference to FIG. 5, in some examples of the arrangement shown, one or more individual diamond shaped lugs 405 may include a surface enhancement feature that is an aperture 408. The aperture 408 may extend through the lug 405 exposing the midsole or, in some arrangements, exposing a bottom portion of the upper. Alternatively, the aperture 408 may extend through a portion of the lug 405 to expose an interior surface of the lug 405. These apertures 408 provide additional traction and flexibility for the wearer. In addition, the apertures 408 reduce the weight associated with the outsole 400 because less material may be used in forming the outsole 400.

Figure 6:
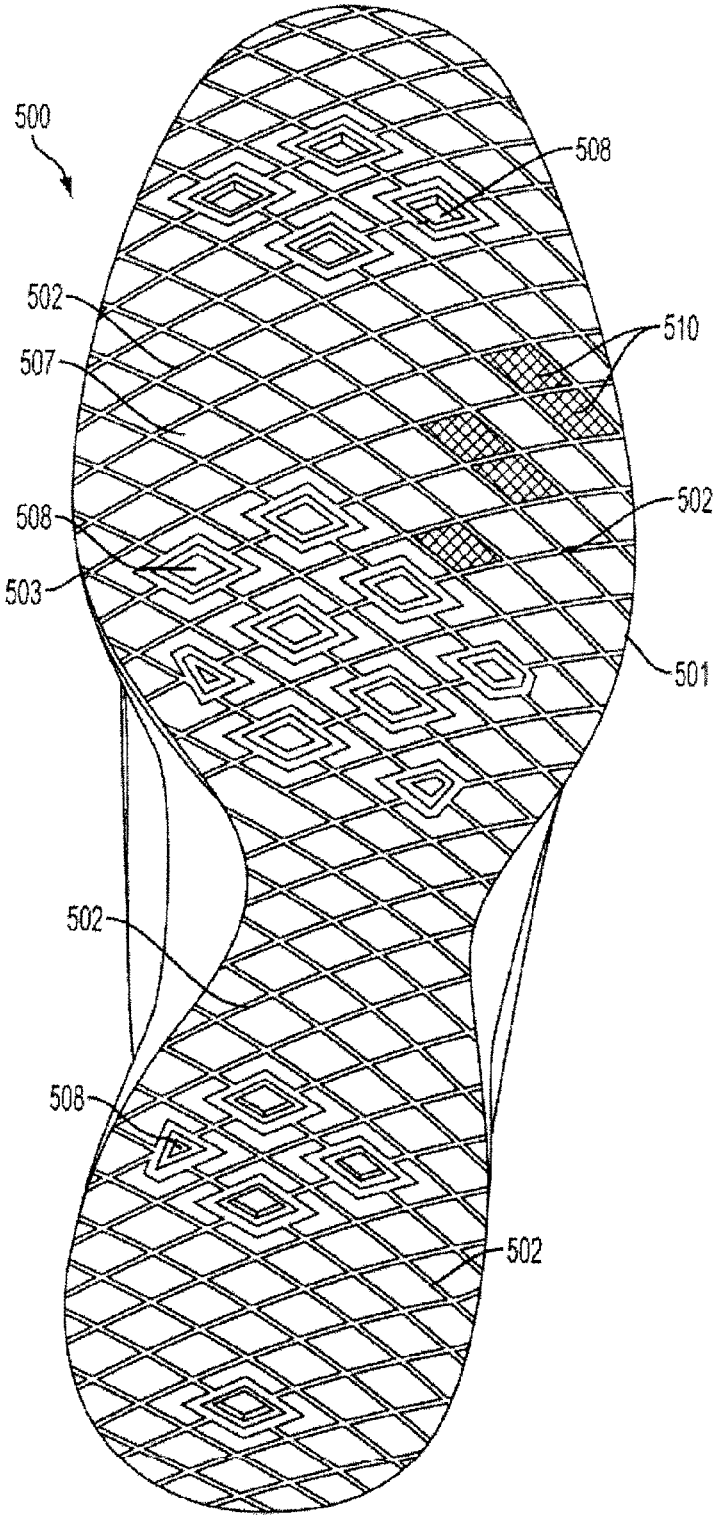
FIG. 6 is a bottom view of an article of footwear having still another outsole arrangement according to aspects of the invention.

FIG. 6 illustrates yet another outsole 500 having grooves 502 forming a diamond shaped lug configuration. The outsole 500 of FIG. 5 includes a plurality of deep grooves 502 traversing substantially all of the outsole 500. Similar to the arrangements discussed above, the deep grooves 502 form discrete, diamond shaped lugs 507 that, together with the grooves 502, provide flexibility and traction for the wearer. The deep grooves 502 of the outsole 500 of FIG. 5 are formed in a generally non-linear configuration. That is, the deep grooves 502 extend from a lateral side 501 of the shoe to a medial side 503 of the shoe in an arced or curved arrangement. These non-linear deep grooves 502 may provide additional flexibility in various twisting motions of the foot or if a user strikes the ground on the medial or lateral side of the foot during the user's gait.

At least some of the diamond shaped lugs 507 formed by these deep grooves 502 may include a pattern or texture 510. The texture or pattern 510 may be substantially the same on each of the lugs 507 or it may vary. For instance, the lugs 507 in the toe region may include one textured pattern 510 while the lugs 507 in the midfoot region include a different textured pattern 510. The textured pattern 510 may provide an improved aesthetic appearance in addition to providing additional traction for the user.

In addition, the outsole of FIG. 6 includes a plurality of apertures 508 formed throughout the outsole 500. The apertures 508 may extend completely through the outsole 500 to expose the midsole or a bottom portion of the upper. Alternatively, the aperture 508 may extend partially through the outsole 500 to expose an inner portion of the outsole 500. The apertures 508 may provide additional traction for the wearer and may also reduce weight associated with the outsole 500.

In some examples, the apertures 508 may include portions formed of a material different from the material from which the remainder of the outsole 500 is formed. For instance, the apertures 508 may include a portion formed of a stiffer or harder material than the remainder of the outsole 500. This may provide additional support for the user in various regions of the foot. The portions may be separately formed inserts that are then connected to the outsole 500 using known methods of attachment or the portions may be integrally formed with the outsole 500.

Figure 7:
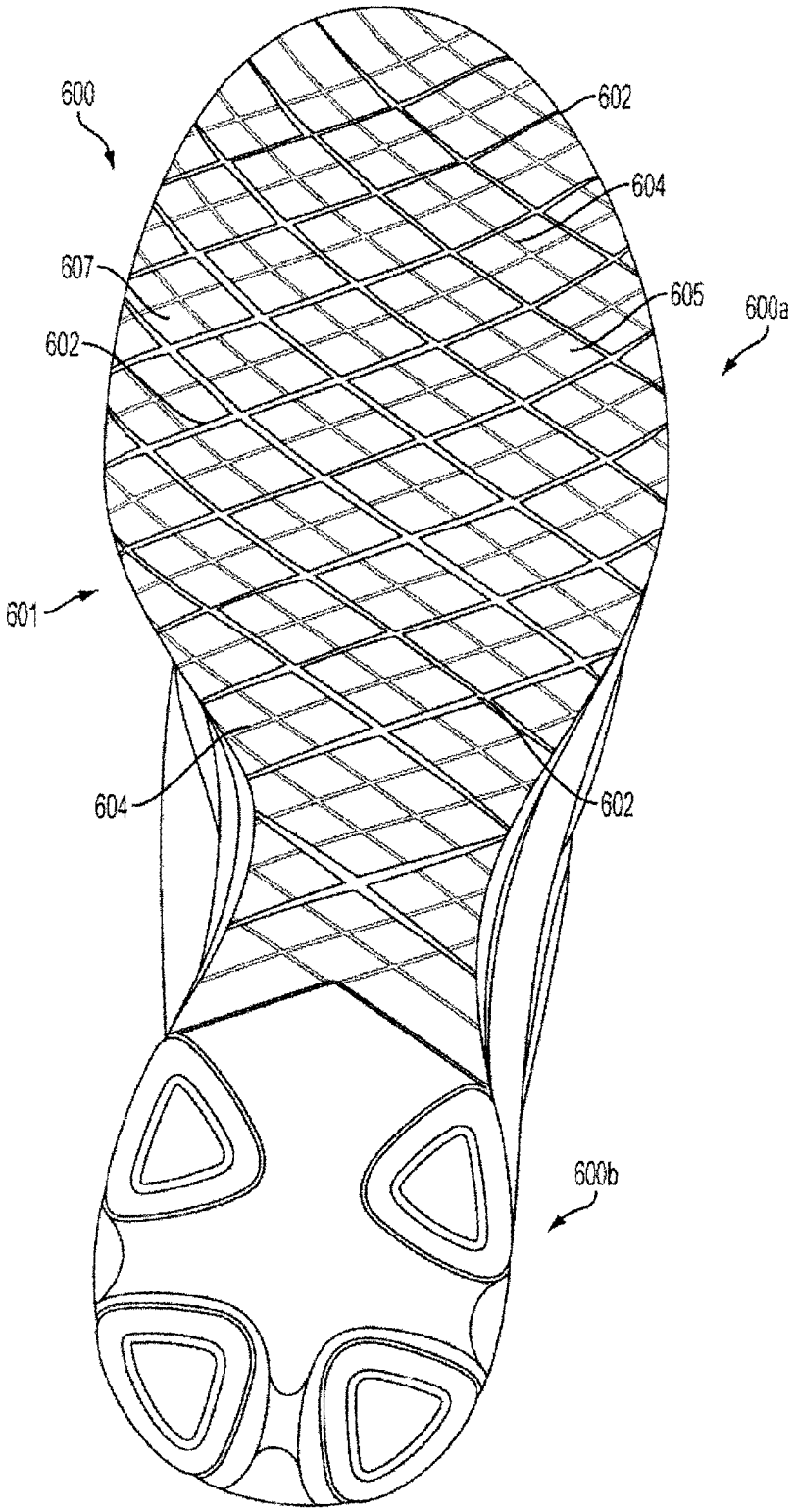
FIG. 7 is a bottom view of an article of footwear having another outsole arrangement according to aspects of the invention.

FIG. 7 illustrates still another arrangement of an outsole 600 having deep grooves 602 forming diamond shaped lugs 607. The arrangement shown includes a forward outsole region 600*a* and a rear outsole region 600*b*. The forward outsole region 600*a* includes an outsole 601 similar to those described above. The outsole 601 includes a plurality of shallow grooves 604 forming individual lugs 605, as well as a plurality of deep grooves 602 forming lugs 607 that encompass one or more of the individual lugs 605. The shallow grooves 604 and deep grooves 602 formed in the outsole 601 have a curved configuration to provide additional flexibility during twisting motions of the foot. In addition, the grooves 602, 604 may have a constant depth or, in some examples, may have a depth that varies from the outer edge of the shoe to the center of the shoe. The arrangement of FIG. 7 includes shallow and deep grooves arranged throughout the outsole region. However, more or fewer grooves may be used with this arrangement.

In addition to the forward outsole region 600*a*, the outsole 600 of FIG. 7 includes a rear outsole region 600*b*. The rear outsole region 600*b* may generally be formed separately from the forward outsole region 600*a* in this arrangement and is connected to the midsole and/or upper. The rear outsole region 600*b* includes an impact attenuation system to provide support to the heel of the user. For instance, the impact attenuation system may include an air filled bladder, one or more column type supports, a foam impact attenuating element, and the like, to provide impact attenuation and support to the wearer. Although the rear outsole arrangement is shown with this particular forward outsole arrangement, the rear outsole arrangement with the impact attenuating system may be used with any of the outsole arrangements described herein.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An outsole for an article of footwear, comprising:

a first plurality of grooves formed in the outsole and extending from a lateral side of the outsole to a medial side of the outsole, the first plurality of grooves intersecting one another and forming a first plurality of discrete lugs; and a second plurality of grooves formed in the outsole and extending from the lateral side of the outsole to the medial side of the outsole, the second plurality of grooves intersecting one another and forming a second plurality of discrete lugs, wherein the first plurality of grooves are deeper than the second plurality of grooves, wherein individual discrete lugs of the first plurality of discrete lugs encompass and include a plurality of individual discrete lugs of the second plurality of discrete lugs.

2. The outsole of claim 1, wherein at least one of the second plurality of discrete lugs includes a lug surface enhancement feature, and wherein the lug surface enhancement feature includes an aperture formed in the lug.

3. The outsole of claim 2, wherein the aperture extends through the entire outsole.

4. The outsole of claim 2, wherein the aperture extends partially through the outsole.

5. The outsole of claim 1, wherein at least one of the second plurality of discrete lugs includes a lug surface enhancement feature, and wherein the lug surface enhancement feature includes a raised area formed on the lug.

6. The outsole of claim 1, wherein the first plurality of grooves are evenly spaced along an entire surface of the outsole.

7. The outsole of claim 1, wherein at least one of the second plurality of discrete lugs includes a lug surface enhancement feature, and wherein the lug surface enhancement feature includes an insert formed of a second material different from a first material forming the lug.

8. The outsole of claim 7, wherein the second material is harder than the first material.

9. The outsole of claim 1, wherein the first plurality of grooves have a first groove depth profile that includes a first groove depth at a perimeter of the outsole and a second groove depth at a center of the outsole.

10. The outsole of claim 9, wherein groove depth increases from the first groove depth to the second groove depth as the groove extends from one of the lateral side and the medial side to a center of the outsole.

11. An outsole for an article of footwear, comprising:

a first plurality of grooves formed in the outsole and extending from a lateral side of the outsole to a medial side of the outsole, the first plurality of grooves intersecting so as to form a first plurality of discrete diamond shaped lugs; and a second plurality of grooves formed in the outsole and extending from the lateral side of the outsole to the medial side of the outsole, the second plurality of grooves intersecting so as to form a second plurality of discrete diamond shaped lugs, wherein the first plurality of grooves are deeper than the second plurality of grooves;

wherein individual lugs of the first plurality of discrete diamond shaped lugs are larger than individual lugs of the second plurality of discrete diamond shaped lugs such that individual lugs of the first plurality of discrete diamond shaped lugs encompass and include a plurality of the second plurality of discrete diamond shaped lugs.

12. The outsole of claim 11, wherein at least one lug of the second plurality of discrete diamond shaped lugs includes a lug surface enhancement feature, and wherein the lug surface enhancement feature is an aperture formed in the lug.

13. The outsole of claim 12, wherein the aperture extends through the entire outsole.

14. The outsole of claim 13, wherein the aperture exposes one of a midsole or an upper of an article of footwear.

15. The outsole of claim 12, wherein the aperture extends partially through the outsole.

16. The outsole of claim 11, wherein at least one lug of the second plurality of discrete diamond shaped lugs includes a lug surface enhancement feature, and wherein the lug surface enhancement feature includes a raised area formed on the lug.

17. The outsole of claim 11, wherein the first plurality of grooves are evenly spaced along an entire surface of the outsole.

18. The outsole of claim 11, wherein at least one lug of the second plurality of discrete diamond shaped lugs includes a lug surface enhancement feature, and wherein the lug surface enhancement feature includes an insert formed of a second material different from a first material forming the lug.

19. The outsole of claim 18, wherein the second material is harder than the first material.

20. The outsole of claim 11, wherein at least one lug of the second plurality of discrete diamond shaped lugs includes a lug surface enhancement feature, and wherein the lug surface enhancement feature is a textured pattern on the lug.

* * * * *